US010794125B2

(12) United States Patent
Clark

(10) Patent No.: US 10,794,125 B2
(45) Date of Patent: Oct. 6, 2020

(54) TUBING IN TUBING BYPASS

(71) Applicant: Joseph D Clark, Kilgore, TX (US)

(72) Inventor: Joseph D Clark, Kilgore, TX (US)

(73) Assignee: Joseph D Clark, Kligore, TX (US)

( * ) Notice: Subject to any disclaimer, the term of this patent is extended or adjusted under 35 U.S.C. 154(b) by 107 days.

(21) Appl. No.: 15/841,188

(22) Filed: Dec. 13, 2017

(65) Prior Publication Data

US 2018/0163487 A1 Jun. 14, 2018

Related U.S. Application Data

(60) Provisional application No. 62/433,657, filed on Dec. 13, 2016.

(51) Int. Cl.

| | |
|---|---|
| ***E21B 17/20*** | (2006.01) |
| ***E21B 47/12*** | (2012.01) |
| ***E21B 43/16*** | (2006.01) |
| ***E21B 47/06*** | (2012.01) |
| ***E21B 33/072*** | (2006.01) |

(52) U.S. Cl.

CPC ..... *E21B 17/206* (2013.01); *E21B 33/072* (2013.01); *E21B 43/168* (2013.01); *E21B 47/06* (2013.01); *E21B 47/12* (2013.01)

(58) Field of Classification Search

CPC ..... E21B 17/206; E21B 33/072; E21B 47/06; E21B 43/168; E21B 34/106; E21B 47/12

See application file for complete search history.

(56) References Cited

U.S. PATENT DOCUMENTS

| | | | | |
|---|---|---|---|---|
| 7,222,676 | B2 * | 5/2007 | Patel | A45C 13/02 166/278 |
| 7,861,786 | B2 * | 1/2011 | Hill, Jr. | E21B 34/106 166/305.1 |
| 2005/0263281 | A1 * | 12/2005 | Lovell | E21B 17/206 166/255.1 |
| 2007/0044960 | A1 * | 3/2007 | Lovell | E21B 17/206 166/250.07 |
| 2007/0151735 | A1 * | 7/2007 | Ravensbergen | E21B 17/203 166/308.1 |
| 2008/0271893 | A1 * | 11/2008 | Hill | E21B 33/068 166/305.1 |
| 2019/0301275 | A1 * | 10/2019 | Oliphant | E21B 34/10 |

* cited by examiner

*Primary Examiner* — Michael R Wills, III

(74) *Attorney, Agent, or Firm* — The Kubiak Law Firm PLLC

(57) ABSTRACT

A system for providing downhole chemical injection to at least a first location while also providing power and/or communication between a tool or sensors located below the first location. The system includes a capillary tubing encasing an inner data cable or second capillary tubing while providing sufficient clearance between the data cable or second capillary tubing and the inner wall of the capillary tubing so that fluid may pass through the first capillary tubing to at least a first location while the data cable may pass through to at least the first location or may pass through and below the first location to a tool or sensor package below.

18 Claims, 4 Drawing Sheets

TUBING IN TUBING BYPASS

CROSS-REFERENCE TO RELATED APPLICATIONS

This application claims priority to U.S. Provisional Patent Application No. 62/433,657 that was filed on Dec. 13, 2016.

BACKGROUND

The controlled injection of materials into oil and gas wells is an established practice frequently used to increase recovery or to analyze production conditions.

Generally, there are two types of well injection. The two types of well injection may be distinguished based upon the quantities of material injected into a well. In the first type large quantities of material are injected into the formation. In some instances, the material may be fracturing fluids in which thousands of barrels of material may be pumped into the well. In another instance large volumes of materials are injected into formations to displace formation fluids towards producing wells. Such as in water flooding.

In the second type of well injection smaller amount of materials may be injected into the formation in order to treat the well. Examples of these treatments may include foaming agents to improve the efficiency of artificial lift, paraffin solvents to prevent deposition of solids on the tubing, biocides to prevent buildup of harmful bacteria, surfactants to improve the flow characteristics of the wellbore fluids, or host of other chemicals and materials to improve the production of the wellbore fluid to the surface. These types of treatment entail modification of the well fluids themselves. Smaller quantities are needed, yet these types of injection chemicals are typically supplied by additional tubing routed downhole from the surface.

Generally, operators will attach a capillary tubing to the exterior of the production tubular as it is run into the well. Capillary tubing is generally stainless steel or other material able to resist the corrosive effects of the fluid and the temperatures downhole while providing a conduit, usually of less than one third the diameter of the production tubular, to the desired location.

Additionally, operators have a need to acquire real time data, such as temperature or pressure, from various downhole locations. Generally, as with capillary tubing the operator will attach a data cable, usually an armored cable having electrical conductors, fiber-optic conductors, or both, to the exterior of the production tubular as it is run into the well.

Unfortunately, both capillary tubing and data cable are easily damaged. As the production tubular is lowered into the well the capillary tubing and/or data cable may be caught between the production tubular and the rock sidewall of the wellbore cutting, crushing, or otherwise damaging the capillary tubing and/or data cable. As the number of cables attached to the production tubular increases so does the potential for damage.

In certain instances, an operator may attempt to place the capillary tubing or data cable within the production tubular. While dual, side-by-side capillary tubing has been performed it has become apparent that more than a single tubing within the production tubular negatively impacts the amount of wellbore fluid may be produced through the tubular and greatly increases the potential for damage to either the capillary tubing or data cable.

SUMMARY OF THE INVENTION

One solution to the problem that running multiple capillary tubing and/or data cables into a wellbore may be found in the preferred embodiment of the current invention. A capillary tubing is constructed having within the interior of the capillary tubing a data cable. By having a data cable within the capillary tubing only a single capillary tubing is run into the wellbore whether attached to the exterior of the tubing or run within the production or other tubular. The capillary tubing provides a conduit for fluid flow from the surface to the desired location within the well while the data cable is protected within the capillary tubing, using capillary tubing for armor.

At the desired location within the well a downhole chemical injection bypass valve is placed. The downhole chemical injection bypass valve has an upper connection that fluidly seals the capillary tubing to the downhole chemical injection bypass valve and typically terminates the outer capillary tubing at the upper connection. The downhole chemical injection bypass valve then provides a pathway for the fluid and the data cable to proceed to the interior of the downhole chemical injection bypass valve. The fluid pathway then proceeds through the downhole chemical injection bypass valve to the exterior of the production tubular and into the wellbore fluid. The downhole chemical injection bypass valve generally includes a check valve to prevent wellbore fluid from entering the downhole chemical injection bypass valve while allowing the fluid within the downhole chemical injection bypass valve and which is supplied through the capillary tubing to exit the downhole chemical injection bypass valve and as previously noted enters the wellbore fluid.

As indicated above, in addition to a fluid pathway the downhole chemical injection bypass valve also provides a pathway for the data cable. Generally the data cable is included in the fluid pathway within the downhole chemical injection bypass valve. At some point within the fluid pathway, usually towards the lower end of the downhole chemical injection bypass valve, the data cable passes through a port to a lower section of the downhole chemical injection bypass valve. A seal is provided at the port to prevent fluid from passing between the data cable and the downhole chemical injection bypass valve.

After the data cable passes through the port to a lower section of the downhole chemical injection bypass valve the data cable may be attached at one or more points to a sensor or sensors, such as a temperature sensor or pressure sensor. The sensor or sensors may utilize the data cable to provide power to the sensors as well as allowing the sensors to communicate with the surface.

The data cable may be a fiber-optic cable, at least a pair of conductors, or combination of conductors and fiber-optics. In some instances, fiber-optic cable shielding may be conductors with an insulating layer between at least two layers. In other instances, the data cable may be a second smaller diameter capillary tubing.

Preferably the capillary tubing is Inconel 123. In order to form the outer capillary tubing a relatively flat metal ribbon is forced through a die that curls the outer longitudinal edges towards the center to form a tubing. As the outer metal is forced through the die the data cable or inner capillary tubing is placed within the outer capillary tubing. The seam is then welded, preferably by laser welding. Generally, the resulting outer tubing has a larger diameter than is desired therefore the outer capillary tubing is then forced to a second die that reduces the diameter as desired. The size of the outer cable and the inner cable are selected so that a sufficient amount of fluid may flow through the outer cable in spite of the loss of cross-sectional area due to the inner cable.

Preferably the outer diameter is ⅜ of an inch while the inner data cable or second capillary tubing diameter is typically ⅛ of an inch.

At the surface is a chemical injection control valve. The chemical injection control valve has a lower connection that fluidly seals the capillary tubing to the chemical injection control valve. Typically, the upper end of the outer capillary tubing terminates at the lower connection to the chemical injection control valve. The chemical injection control valve provides pathway for fluid to move from a pump or other source into the chemical injection control valve and then into the capillary tubing. At the same time the chemical injection control valve also provides a pathway for the data cable to pass from the capillary tubing through the fluid seal and into the capillary injection control valve. The chemical injection control valve then provides an additional pathway for the data cable to pass from the fluid pathway to the exterior of the chemical injection control valve where the data cable may then be connected to various surface equipment such as data log or computer.

An alternative embodiment the data cable may be a second capillary tubing of smaller diameter than the outer capillary tubing. The second capillary tubing may pass through the downhole chemical injection bypass valve in the same manner as the data cable and then be attached to a peripheral device that may be actuated with fluid from the second capillary tubing. In other instances, fluid in the second capillary tubing may be a second treatment chemical for the wellbore fluid.

In an alternative embodiment the downhole chemical injection bypass valve may provide a second fluid pathway so that while fluid is able to exit from the downhole chemical injection bypass valve in and into the wellbore fluid at a first location, other portions of the same fluid may be allowed to progress further down the well to exit from a second downhole chemical injection bypass valve in and into the wellbore fluid at a second location. At the same time the data cable may be accessed to provide a signal from the first location, which may have temperature sensors and or pressure sensors. With the second portion of the fluid passing from the first downhole chemical injection bypass valve through additional capillary tubing to location further down the well, the data cable may also pass through the first downhole chemical injection bypass valve to the second downhole chemical injection bypass valve where the data cable may be again accessed to provide a signal from the second location which may include temperature sensors and/or pressure sensors.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
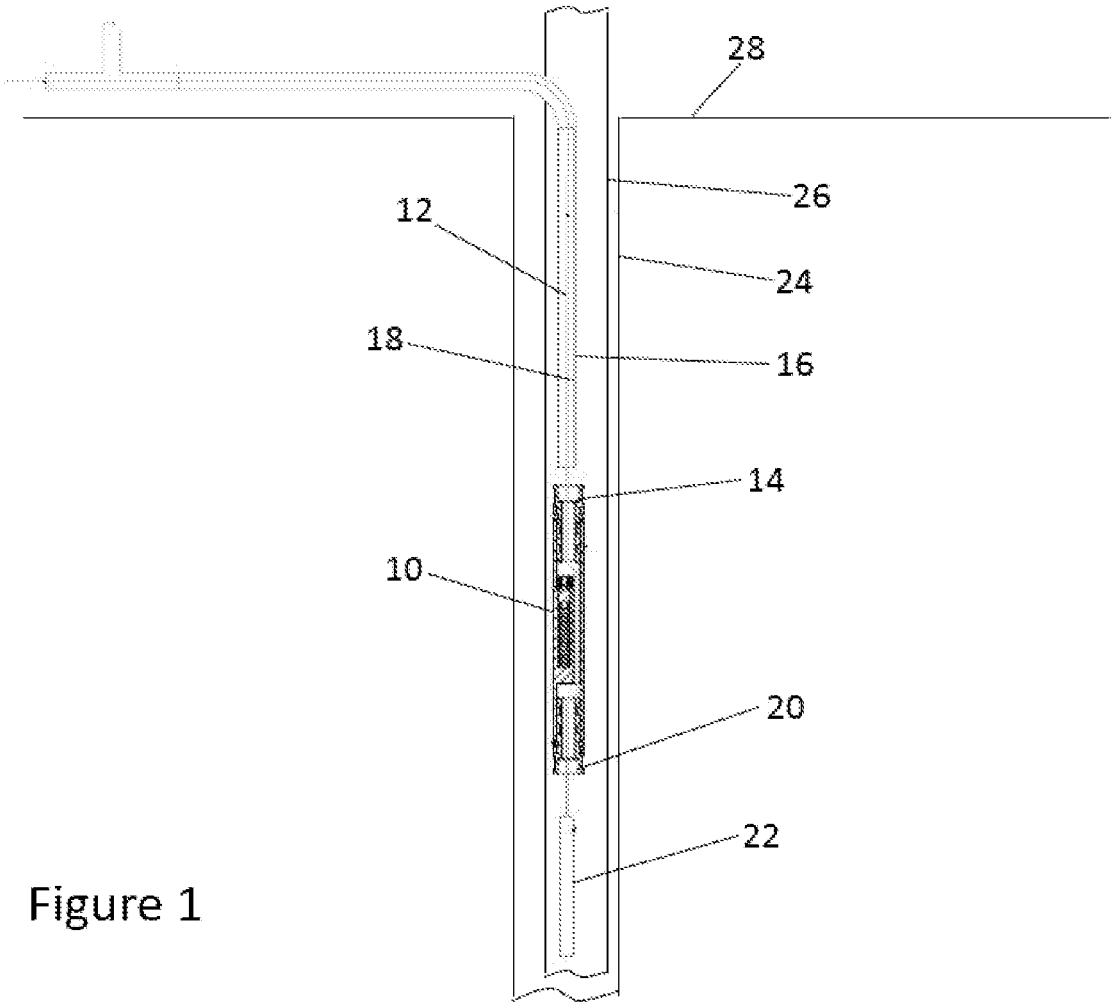
FIG. 1 depicts a wellbore having within the wellbore a production tubular, a data cable within a capillary tubing, and a downhole chemical injection bypass valve.

FIG. 1 depicts a wellbore 24 having within the wellbore 24 a production tubular 26 where the production tubular 26 extends out of the wellbore 24 generally past the surface 28. Within the production tubular 26 is a downhole chemical injection bypass valve 10 with a tube-in-tube capillary line 12 located at the upper end 14 of the downhole chemical injection bypass valve 10. In some instances the downhole chemical injection bypass valve 10 and the tube-in-tube capillary line 12 may be attached to the outside of the production tubular 26. In order to show the inner data cable 18 as the inner data cable 18 enters into the downhole chemical injection bypass valve 10 the outer capillary tubing 16 is depicted as terminating at some distance above the downhole chemical injection bypass valve 10. In practice the outer capillary tubing 16 will extend into the upper end of the downhole chemical injection bypass valve 10 where the outer capillary tubing is sealed to the downhole chemical injection bypass valve 10. At the lower end 20 of the downhole chemical injection bypass valve 10 is a sensor package 22. As before in order to show the inner data cable 18 is the inner data cable 18 leaves the lower end 20 of the downhole chemical injection bypass valve 10 the sensor package 22 is depicted as being separated by some distance from the downhole chemical injection bypass valve 10. In practice the sensor package 22 will be connected to the downhole chemical injection bypass valve 10 although in some instances the sensor package 22 may be separated by some distance from the downhole chemical injection bypass valve 10. In any event the inner data cable 18 will be fluidly sealed to the downhole chemical injection bypass valve 10 as the inner data cable 18 passes through the lower end 20 of the downhole chemical injection bypass valve 10.

Figure 2:
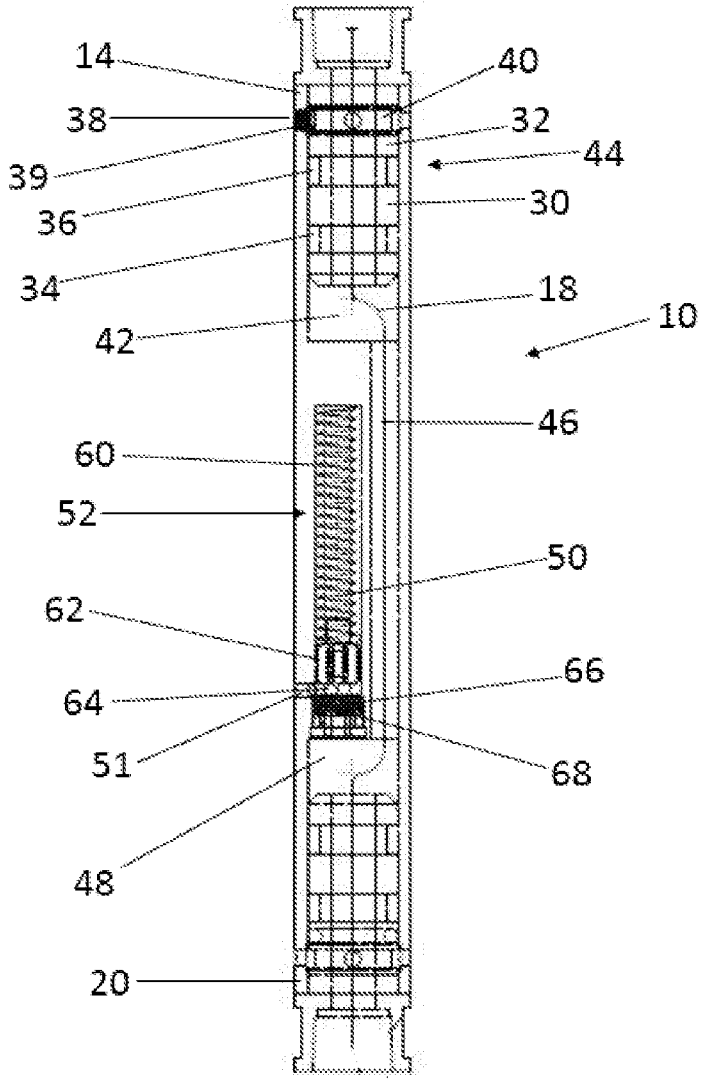
FIG. 2 depicts a downhole chemical injection bypass valve having the inner data cable passing through the downhole chemical injection bypass valve.

FIG. 2 is a close-up of the downhole chemical injection bypass valve 10 from FIG. 1. The downhole chemical injection bypass valve 10 has an upper end 14 and a lower end 20. The upper end 14 is generally configured to include an upper chamber 42 so that fluid tight seal 44, which may be generally considered to be a portion of the outer capillary tubing 16 may be inserted into upper chamber 42 where the fluid tight seal 44 is both fluidly sealed and firmly connected to the upper end 14 of the downhole chemical injection bypass valve 10. As depicted the fluid tight seal 44 generally includes a first compression fitting 30, a second compression fitting 32, a first O ring 34, a second O-ring 36, and a recess 40. As depicted at least one set screw 38 passes through a threaded port 39 to engage the recess 40 thereby fixing the outer capillary tubing 16 firmly to the upper end 14 of the downhole chemical injection bypass valve 10.

The outer capillary tubing 16 terminates within the fluid tight seal 44 while the inner data cable 18 continues into the upper chamber 42. The inner data cable 18 is then diverted into passageway 46. The inner data cable 18 then enters lower chamber 48.

Fluidly connected to lower chamber 48 is mid-chamber 50. Mid-chamber 50 has at least one port 51 to allow fluid access between mid-chamber 50 and the exterior of the downhole chemical injection bypass valve 10. Within mid-chamber 50 is check valve 52. Generally, the check valve 52 has a biasing device 60, a ball guide 62, a ball 64, and a seat 66. As depicted the seat 66 is retained within mid-chamber 50 by threads 68. The seat may be retained within mid-chamber 50 by sheer pins, c-rings, welding, or any other means to retain the seat known within the industry. The biasing device 60 is generally a spring but could be compressible rubber or gas within a bellows system. The biasing device 60 is fixed to ball 64 and in turn presses ball 64 against seat 66 to block fluid flow through mid-chamber 50. Fluid from the outside of the downhole chemical injection bypass valve 10 flowing inwards through port 51 is generally prevented from flowing past the ball 64 and seat 66 while fluid from the inside of the downhole chemical injection bypass valve 10 flowing outwards through port 51 is able to shift the ball 64 off of seat 66 and allow fluid to flow past the ball 64 and seat 66 to treat the fluid outside of the downhole chemical injection bypass valve 10.

While fluid is contained within lower chamber 48 the inner data cable 18 is routed towards the lower end 20 of the downhole chemical injection bypass valve 10. Outer capillary tubing, similar to outer capillary tubing 16, may be attached via fluid tight seal to the lower end 20 of the downhole chemical injection bypass valve 10. Alternatively, a sensor package such as sensor package 22 which may include a temperature and/or pressure sensor may be attached via fluid tight seal to the lower end 20 of the downhole chemical injection bypass valve 10. With the sensor package 22 attached to the lower end of the downhole chemical injection bypass valve 10 fluid is prevented from exiting lower chamber 48 through any pathway other than through flow ports 51. However, the inner data cable 18 is provided with the fluid tight path through the lower end of the downhole chemical injection bypass valve so that the inner data cable may be connected to sensor package 22. Sensor package 22 may be provided with power through the inner data cable 18 as well as communicate with the surface via data cable 18. In certain instances, the communication may be over the power lines or multiple conductors may be provided separately from the power lines. In some instances, inner data cable 18 may be provided with conductors for power conductors for communication and fiber optics for communication between the surface and the sensors instance a package 22.

In certain instances, inner data cable 18 may be attached to sensor package 22 or inner data cable may be attached to a separate device or tool such as a sliding sleeve where the inner data cable 18 provides power to actuate the tool upon a command from the surface. In certain other instances inner data cable 18 may be replaced by or incorporate a fluid conduit where the fluid conduit may be used to provide a second treatment chemical to a desired location within the well or may provide a hydraulic fluid pathway to provide for hydraulic power to actuate a tool at some location within the well.

Figure 3:
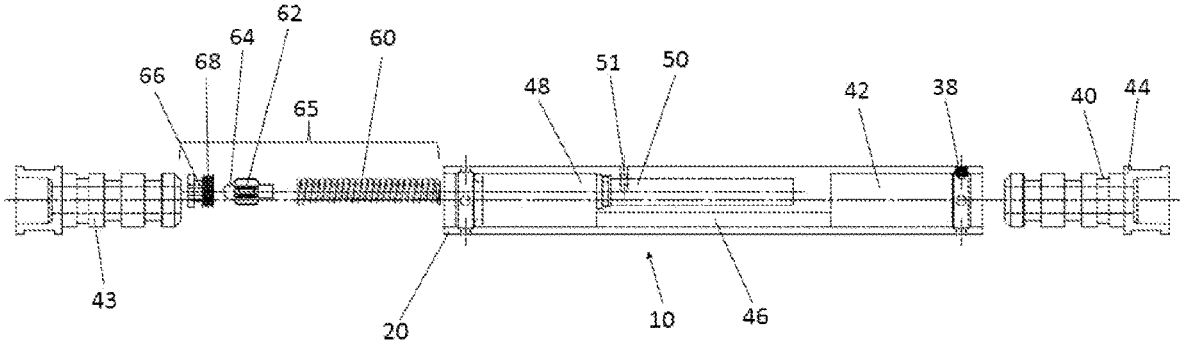
FIG. 3 depicts an exploded view of a downhole chemical injection bypass valve.

FIG. 3 is an exploded view of the downhole chemical injection bypass valve 10. The fluid tight seal 44 is generally a compression fitting that allows outer capillary tubing 16 to be fluidly attached to upper chamber 42. As depicted compression fitting 44 is held in place within upper chamber 42 by at least one set screw 38 that engages recess 40 in compression fitting 44. Upper chamber 42 is fluidly connected to passageway 46 which in turn is fluidly connected to lower chamber 48. Lower chamber 48 is in turn fluidly connected to mid-chamber 50. Mid-chamber 50 includes port 51. Generally lower chamber 48 is fluidly sealed by a lower compression fitting 43 so that fluid passing through passageway 46 and into chamber 48 must move into mid-chamber 50 and if sufficient pressure exists to move the ball 64 off of seat 66 then the fluid may pass through port 51 and into the produced fluids. As can be seen the check valve 65 consists of biasing device 60 which fits into mid-chamber 50 followed by ball guide 62 to which ball 64 is fixed then seat 66 is placed within the lower end of mid-chamber 50 and held in place by threads 68. While the outer capillary tubing 16 terminates at the upper compression fitting 44 the inner data cable 18 proceeds through the interior of upper compression fitting 44 along with any fluid that is being pumped through the outer capillary tubing 16. Both the fluid and the inner data cable 18 pass through upper chamber 42 into passageway 46 and then in the lower chamber 48. At lower chamber 48 the fluid is routed back towards mid-chamber 50 while the inner data cable 18 is routed through lower compression fitting 43 where lower compression fitting 43 is sealed to enter data cable 18 preventing any fluid from passing beyond lower compression fitting 43.

Figure 4:
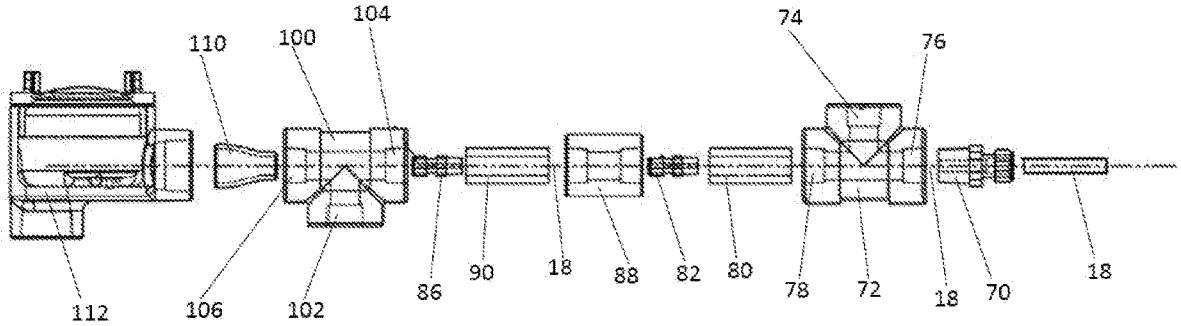
FIG. 4 depicts a surface fluid injection and data access assembly.

FIG. 4 depicts the surface assembly where the outer capillary tubing 18 is sealed to the fluid tee 72 by compression fitting 70 which forms a fluid tight seal between outer capillary tubing 18 and fluid tee 72. Fluid tee 72 has a fluid inlet 74 and a fluid outlet 76 compression fitting 70 fits within fluid outlet 76 to seal outer capillary tubing 18 to fluid outlet 76 fluid tee 72 has a second inlet 78. Second inlet 78 has an adapter 80, although in some instances the adapter 80 may be omitted, to which a first compression seal 82 may be fitted first compression seal 82 allows inner data cable 18 to pass from the interior of outer capillary tubing 18 through the fluid tee 72 through adapter 80 and through compression seal 82 where compression seal 82 in conjunction with adapter 80 forms a fluid tight seal between inner data cable 18 and fluid tee 72. In many instances a second compression seal 86 in conjunction with tubing adapter 88 and second adapter 90 form a second fluid tight seal between inner data cable 18 and fluid tee 72. In some instances inner data cable 18 may include or be replaced by a second capillary tubing in such instances the second capillary tubing as it passes through the second compression seal 86 will enter into a second fluid tee 100 where the second fluid tee 100 has a first inlet 102, an outlet 104, and a second inlet 106 the data cable may continue through the second fluid tee 100 where the conductors or fiber-optic cable may then pass through the gas block 110 where the inner data cable 18 is connected to surface electronics or controller 112. In the instances where a second fluid tee 100 and the second capillary tubing is added to the system. Fluid for the second capillary tubing is provided through the second tee 100.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole tool within a well comprising:

a first capillary tube, wherein the first capillary tube terminates at an upper end of an injection bypass valve, a second capillary tube, wherein the second capillary tube and a first fluid are in an interior of the first capillary tube, the injection bypass valve having a first port to an exterior, a second port to the exterior, and a check valve, wherein the injection bypass valve has a fluid pathway between the first capillary tube and the check valve, wherein the check valve blocks the first port against the first fluid below a predetermined pressure, wherein the second capillary tube passes through the injection bypass valve second port, and wherein the injection bypass valve second port is sealed against fluid flow.

2. The downhole tool within the well of claim 1, wherein the check valve has a seat, a plug, and a bias device.

3. The downhole tool within the well of claim 2, wherein the bias device is a gas bellows.

4. The downhole tool within the well of claim 2, wherein the bias device is a spring.

5. The downhole tool within the well of claim 1, wherein the second capillary tube includes a fluid in an interior of the second capillary tube.

6. The downhole tool within the well of claim 1, wherein the second capillary tube includes at least two conductors.

7. The downhole tool within the well of claim 6, wherein the at least two conductors provide power to a location within the well.

8. The downhole tool within the well of claim 6, wherein the at least two conductors provide communication between the location within the well and a surface location.

9. A downhole tool within a well comprising: a first capillary tube, wherein the first capillary tube terminates at an upper end of a first injection bypass valve, a second capillary tube, wherein the second capillary tube and a first fluid are in an interior of the first capillary tube, the first injection bypass valve having a first port to an exterior, a second port to the exterior, and a first check valve, wherein the injection bypass valve has a fluid pathway between the first capillary tube and the check valve, wherein the first check valve blocks the first injection bypass valve first port against the first fluid below a predetermined pressure, a third capillary tube, wherein the third capillary tube and a first fluid are in an interior of the second capillary tube, wherein the second capillary tube, the third capillary tube, and at least a portion of the first fluid pass through the first injection bypass valve second port, a second injection bypass valve having a third port to an exterior of the second injection bypass valve, a fourth port to the exterior of the second injection bypass valve, and a second check valve, wherein the second capillary tube terminates at an upper end of the first injection bypass valve, wherein the second check valve blocks the third port against the first fluid below a second predetermined pressure, wherein the second capillary tube passes through the second injection bypass valve fourth port, and wherein the injection bypass valve fourth port is sealed against fluid flow.

10. The downhole tool within the well of claim 9, wherein the predetermined pressure and the second predetermined pressure are equal.

11. The downhole tool within the well of claim 9, wherein the predetermined pressure and the second predetermined pressure are different.

12. The downhole tool within the well of claim 9, wherein the check valve has a seat, a plug, and a bias device.

13. The downhole tool within the well of claim 12, wherein the bias device is a gas bellows.

14. The downhole tool within the well of claim 12, wherein the bias device is a spring.

15. The downhole tool within the well of claim 9, wherein the second capillary tube includes a fluid in an interior of the second capillary tube.

16. The downhole tool within the well of claim 9, wherein the second capillary tube includes at least two conductors.

17. The downhole tool within the well of claim 16, wherein the at least two conductors provide power to a location within the well.

18. The downhole tool within the well of claim 16, wherein the at least two conductors provide communication between the location within the well and a surface location.

* * * * *